US010054081B2

(12) United States Patent
Rotter et al.

(10) Patent No.: US 10,054,081 B2
(45) Date of Patent: Aug. 21, 2018

(54) AUTOMATIC STARTING SYSTEM

(71) Applicant: Kohler Co., Kohler, WI (US)

(72) Inventors: Terrence Rotter, Sheboygan Falls, WI (US); Gary Stenz, Mt. Calvery, WI (US); Anthony Freund, Fond du Lac, WI (US); David Torres, Cedarburg, WI (US)

(73) Assignee: Kohler Co., Kohler, WI (US)

( * ) Notice: Subject to any disclaimer, the term of this patent is extended or adjusted under 35 U.S.C. 154(b) by 374 days.

(21) Appl. No.: 14/880,748

(22) Filed: Oct. 12, 2015

(65) Prior Publication Data

US 2016/0108856 A1 Apr. 21, 2016

Related U.S. Application Data

(60) Provisional application No. 62/065,426, filed on Oct. 17, 2014.

(51) Int. Cl.

| | |
|---|---|
| ***B01F 3/04*** | (2006.01) |
| ***F02M 1/12*** | (2006.01) |
| ***F02M 1/08*** | (2006.01) |
| ***F02M 1/10*** | (2006.01) |
| ***F02M 1/02*** | (2006.01) |
| ***F02M 1/14*** | (2006.01) |
| ***B01F 15/02*** | (2006.01) |
| ***F02M 7/12*** | (2006.01) |
| *F02D 9/02* | (2006.01) |

(52) U.S. Cl.

CPC ..... *F02M 1/12* (2013.01); *B01F 3/04* (2013.01); *B01F 15/0216* (2013.01); *F02M 1/02* (2013.01); *F02M 1/08* (2013.01); *F02M 1/10* (2013.01); *F02M 1/14* (2013.01); *F02M 7/12* (2013.01); *F02D 2009/0216* (2013.01)

(58) Field of Classification Search

CPC ..... B01F 3/04; F02M 1/08; F02M 1/04
USPC ..... 261/38, 39.1, 39.3, 39.4; 236/92 D, 92 R
See application file for complete search history.

(56) References Cited

U.S. PATENT DOCUMENTS

| | | | |
|---|---|---|---|
| 1,551,385 | A | 8/1925 | Myron |
| 2,684,057 | A | 7/1954 | Bolton |

(Continued)

FOREIGN PATENT DOCUMENTS

| | | | |
|---|---|---|---|
| CA | 1150384 | A | 7/1983 |
| CN | 2330795 | Y | 7/1999 |

(Continued)

OTHER PUBLICATIONS

Chinese Office Action for Chinese Patent Application No. 201510672511.2 dated Aug. 31, 2017, with summary.

(Continued)

*Primary Examiner* — Robert A Hopkins
(74) *Attorney, Agent, or Firm* — Lempia Summerfield Katz LLC

(57) ABSTRACT

An automatic starting system includes a choke or similar apparatus. The apparatus includes at least a choke plate, a choke arm, and a control arm. The choke plate is configured to control a ratio of fuel and air for an engine. The choke arm is fixedly coupled with the choke plate. The control arm adjustably coupled with the choke arm. The control arm and the choke arm cooperate to move the choke plate into multiple positions, which correspond to multiple ratios of fuel and air for the engine.

20 Claims, 15 Drawing Sheets

(56) References Cited

U.S. PATENT DOCUMENTS 2,854,225 A 9/1958 Skay
2,998,233 A 8/1961 Marsee
3,263,661 A 8/1966 Marsee
3,272,486 A 9/1966 Lucas et al.
3,315,949 A 4/1967 Sutton
3,321,193 A 5/1967 Highley
3,326,196 A 6/1967 Kaufman
3,328,011 A 6/1967 Winkler et al.
3,534,720 A 10/1970 Dubois
3,652,869 A 3/1972 Holt
3,685,809 A 8/1972 Manning
3,699,937 A 10/1972 De Petris
3,730,498 A 5/1973 Keenon
3,732,856 A 5/1973 Firey
3,749,069 A 7/1973 Reese
3,752,133 A 8/1973 Irish et al.
3,768,453 A 10/1973 Hurst
3,780,718 A 12/1973 Nambu et al.
3,789,815 A 2/1974 Schreiner
3,791,358 A 2/1974 Masaki et al.
3,806,854 A 4/1974 Armstrong
3,807,172 A 4/1974 Masaki
3,818,881 A 6/1974 Hosho et al.
3,861,366 A 1/1975 Masaki et al.
3,868,935 A 3/1975 Liebman et al.
3,872,847 A 3/1975 Charron et al.
3,897,765 A 8/1975 Harrison et al.
3,934,565 A 1/1976 Matsumoto et al.
3,947,531 A 3/1976 Branigin
3,948,240 A 4/1976 Hirosawa et al.
3,956,433 A 5/1976 Garcea
3,956,434 A 5/1976 Dickensheets et al.
3,960,130 A 6/1976 Peterson, Jr.
3,972,311 A 8/1976 DePetris
4,003,355 A 1/1977 Kamezaki et al.
4,005,690 A 2/1977 Hirosawa et al.
4,009,695 A 3/1977 Ule
4,010,722 A 3/1977 Laprade et al.
4,011,844 A 3/1977 Hirosawa et al.
4,019,470 A 4/1977 Asano
4,027,640 A 6/1977 Hirosawa et al.
4,033,232 A 7/1977 Benjamin et al.
4,038,955 A 8/1977 Paulmier
4,048,964 A 9/1977 Kissel
4,050,424 A 9/1977 Nelson
4,058,097 A 11/1977 Hutton et al.
4,081,499 A 3/1978 Ishii et al.
4,083,336 A 4/1978 Armstrong et al.
4,096,837 A 6/1978 Iiyama et al.
4,111,010 A 9/1978 Minami
4,114,584 A 9/1978 Rogerson et al.
4,118,444 A 10/1978 Abbey
4,181,107 A 1/1980 Nomura et al.
4,237,077 A 12/1980 Berg
4,237,078 A 12/1980 Benjamin
4,271,802 A 6/1981 Hori et al.
4,279,230 A 7/1981 Bauer et al.
4,280,462 A 7/1981 Kuroiwa et al.
4,291,659 A 9/1981 Suzuki et al.
4,292,946 A 10/1981 Masaki
4,298,549 A 11/1981 Woodworth
4,307,696 A 12/1981 Noji et al.
4,321,902 A 3/1982 Stoltman
4,331,615 A 5/1982 Walstra et al.
4,344,898 A 8/1982 Takada et al.
4,348,996 A 9/1982 Morozumi
4,349,877 A 9/1982 Oyama et al.
4,351,782 A 9/1982 Bellicardi et al.
4,352,346 A 10/1982 Osano et al.
4,352,347 A 10/1982 Osano et al.
4,354,461 A 10/1982 Heismann et al.
4,383,409 A 5/1983 Otsuka et al.
4,388,905 A 6/1983 Kurihara
4,391,249 A 7/1983 Bianchi et al.
4,391,251 A 7/1983 Planteline et al.
4,393,838 A 7/1983 Muscatell
4,399,792 A 8/1983 Otsuka et al.
4,425,886 A 1/1984 Kuroiwa et al.
4,428,349 A 1/1984 Snow
4,433,665 A 2/1984 Abe et al.
4,450,812 A 5/1984 Otsuka et al.
4,457,271 A 7/1984 Fitch
4,463,723 A 8/1984 Tansuwan
4,475,502 A 10/1984 Matsumoto
4,484,554 A 11/1984 Nakajima et al.
4,487,187 A 12/1984 Petro
4,493,303 A 1/1985 Thompson et al.
4,495,922 A 1/1985 Fujimura et al.
4,496,496 A 1/1985 Walstra
4,497,296 A 2/1985 Nakajima et al.
4,498,440 A 2/1985 Nomura et al.
4,510,739 A 4/1985 Dluhosch
4,510,907 A 4/1985 Atago et al.
4,522,177 A 6/1985 Kawai et al.
4,524,742 A 6/1985 Bonfiglioli et al.
4,527,527 A 7/1985 Irino et al.
4,545,345 A 10/1985 Pagdin et al.
4,563,990 A 1/1986 Kishida et al.
4,569,321 A 2/1986 Bonfiglioli et al.
4,576,132 A 3/1986 Nakajima et al.
4,591,699 A 5/1986 Sato et al.
4,612,770 A 9/1986 Tadokoro et al.
4,662,333 A 5/1987 Martel
4,699,738 A 10/1987 DePetris
4,730,589 A 3/1988 Ohtaki et al.
4,753,209 A 6/1988 Hibino et al.
4,768,478 A 9/1988 Martel
4,788,014 A 11/1988 Kanno
4,903,670 A 2/1990 Bauder
5,012,780 A 5/1991 Bugamelli
5,031,593 A 7/1991 Erhard et al.
5,092,295 A 3/1992 Kobayashi
5,261,382 A 11/1993 Nikolai
5,408,981 A 4/1995 Tomisawa
5,476,132 A 12/1995 Jacobson
5,511,519 A 4/1996 Watson et al.
5,537,964 A 7/1996 Hoshiba
5,581,986 A 12/1996 Calver
5,626,118 A 5/1997 Sugii
5,632,248 A 5/1997 Sugii
5,660,765 A 8/1997 King et al.
5,832,888 A 11/1998 Griffiths et al.
5,855,195 A 1/1999 Oikawa et al.
5,992,829 A 11/1999 Andreasson
6,012,420 A 1/2000 Dykstra et al.
6,082,323 A 7/2000 Winberg
6,145,487 A 11/2000 Dykstra e al.
6,186,117 B1 2/2001 Matte
6,213,083 B1 4/2001 Winberg
6,536,747 B2 3/2003 Burns et al.
6,560,528 B1 5/2003 Gitlin et al.
6,691,683 B2 2/2004 Gracyalny et al.
6,722,638 B2 4/2004 Kojima et al.
6,752,110 B2 6/2004 Tharman et al.
6,830,023 B2 12/2004 Tharman et al.
6,896,245 B2 5/2005 Suzuki et al.
6,899,072 B2 5/2005 Spitler
6,932,058 B2 8/2005 Nickel et al.
6,935,308 B1 8/2005 Nakamoto et al.
6,986,340 B2 1/2006 Gracyalny et al.
6,990,969 B2 1/2006 Roth et al.
7,069,915 B2 7/2006 Brandenburg et al.
7,097,163 B2 8/2006 Moriyama et al.
7,117,834 B2 10/2006 Kamimura et al.
7,118,097 B2 10/2006 Moriyama et al.
7,128,036 B2 10/2006 Suzuki
7,128,309 B2 10/2006 Edamatsu et al.
7,144,000 B2 12/2006 Roth et al.
7,146,962 B2 12/2006 Sugimoto et al.
7,156,376 B2 1/2007 Bungo et al.
7,171,947 B2 2/2007 Fukushima et al.
7,204,232 B2 4/2007 Matsuda
7,213,555 B2 5/2007 Kamimura et al.
7,231,900 B1 6/2007 Hanshaw

(56) References Cited

U.S. PATENT DOCUMENTS

| | | | | |
|---|---|---|---|---|
| 7,246,591 | B2 | 7/2007 | Shinogi et al. | |
| 7,246,794 | B2 | 7/2007 | Suzuki et al. | |
| 7,263,981 | B2 | 9/2007 | Woody | |
| 7,284,522 | B2 | 10/2007 | Kamimura et al. | |
| 7,331,326 | B2 | 2/2008 | Arai et al. | |
| 7,344,125 | B2 | 3/2008 | Matsuda et al. | |
| 7,395,811 | B2 | 7/2008 | Bellato et al. | |
| 7,424,884 | B2 | 9/2008 | Woody | |
| 7,487,608 | B2 | 2/2009 | Yamazaki et al. | |
| 7,525,287 | B2 | 4/2009 | Miyashita et al. | |
| 7,536,991 | B2 | 5/2009 | Kadam et al. | |
| 7,568,472 | B2 | 8/2009 | Woody | |
| 7,628,387 | B1 | 12/2009 | Clouse et al. | |
| 7,673,402 | B2 | 3/2010 | Wakitani et al. | |
| 7,681,339 | B2 | 3/2010 | Wakitani et al. | |
| 7,798,128 | B2 | 9/2010 | Bellistri et al. | |
| 7,854,216 | B2 | 12/2010 | Kasai et al. | |
| 7,886,716 | B1 | 2/2011 | Arai et al. | |
| 7,997,016 | B2 | 8/2011 | Yamazaki et al. | |
| 8,005,603 | B2 | 8/2011 | Fisher et al. | |
| 8,036,818 | B2 | 10/2011 | Kasai et al. | |
| 8,113,166 | B2 | 2/2012 | Kumagai et al. | |
| 8,146,558 | B2 | 4/2012 | Clouse et al. | |
| 8,215,286 | B2 | 7/2012 | Maekawa et al. | |
| 8,219,305 | B2 | 7/2012 | Iwata et al. | |
| 8,240,639 | B2 | 8/2012 | Roth | |
| 8,256,396 | B2 | 9/2012 | Emmerich et al. | |
| 8,261,712 | B2 | 9/2012 | Sotiriades | |
| 8,386,149 | B2 | 2/2013 | Bellistri et al. | |
| 8,434,444 | B2 | 5/2013 | Iwata et al. | |
| 8,434,445 | B2 | 5/2013 | Iwata et al. | |
| 8,448,622 | B2 | 5/2013 | Raasch | |
| 8,489,310 | B2 | 7/2013 | Shimamura et al. | |
| 8,495,995 | B2 | 7/2013 | Drew et al. | |
| 8,695,950 | B2 | 4/2014 | Takesue | |
| 9,273,636 | B2 * | 3/2016 | Zuo | F02M 1/10 |
| 2005/0098907 | A1 | 5/2005 | Richard et al. | |
| 2005/0200030 | A1 | 9/2005 | Kamimura et al. | |
| 2006/0266330 | A1 | 11/2006 | Fukushima et al. | |
| 2007/0084444 | A1 | 4/2007 | Bellistri et al. | |
| 2008/0053746 | A1 | 3/2008 | Albert et al. | |
| 2008/0245331 | A1 | 10/2008 | Kumagai et al. | |
| 2008/0245339 | A1 | 10/2008 | Kumagai et al. | |
| 2009/0260596 | A1 | 10/2009 | Johnson | |
| 2010/0269787 | A1 | 10/2010 | Shimamura et al. | |
| 2011/0030640 | A1 | 2/2011 | Raasch | |
| 2011/0088661 | A1 | 4/2011 | Sczomak et al. | |
| 2011/0114055 | A1 | 5/2011 | Naegele et al. | |
| 2012/0118254 | A1 | 5/2012 | Leufen et al. | |
| 2012/0161341 | A1 | 6/2012 | Arai | |
| 2013/0000586 | A1 | 1/2013 | Zuo et al. | |
| 2013/0133618 | A1 | 5/2013 | Larsson et al. | |
| 2013/0206093 | A1 | 8/2013 | Visuri et al. | |
| 2013/0291845 | A1 | 11/2013 | Drew et al. | |

FOREIGN PATENT DOCUMENTS

| | | | |
|---|---|---|---|
| CN | 1829857 | A | 9/2006 |
| CN | 101113706 | A | 1/2008 |
| CN | 101289971 | A | 10/2008 |
| CN | 201225209 | Y | 4/2009 |
| CN | 201280978 | Y | 7/2009 |
| CN | 201306223 | Y | 9/2009 |
| CN | 201321902 | Y | 10/2009 |
| CN | 201810423 | U | 4/2011 |
| CN | 202402169 | U | 8/2012 |
| CN | 202402170 | U | 8/2012 |
| CN | 203702371 | U | 7/2014 |
| DE | 102009037294 | A1 | 2/2011 |
| DE | 202011000519 | U1 | 6/2012 |
| EP | 0046599 | A2 | 3/1982 |
| EP | 46599 | A3 | 8/1982 |
| EP | 0115447 | A1 | 8/1984 |
| EP | 0183879 | A1 | 6/1986 |
| EP | 115447 | B1 | 10/1987 |
| EP | 1253308 | A1 | 10/2002 |
| EP | 1253308 | B1 | 11/2005 |
| EP | 1835154 | A1 | 9/2007 |
| EP | 2112355 | A1 | 10/2009 |
| EP | 2128420 | A2 | 12/2009 |
| GB | 1446993 | A | 8/1976 |
| GB | 1483175 | A | 8/1977 |
| GB | 1488452 | A | 10/1977 |
| GB | 1490922 | A | 11/1977 |
| GB | 1498777 | A | 1/1978 |
| GB | 2041086 | A | 9/1980 |
| IN | 01030MUM2000 | A | 12/2005 |
| JP | 59039955 | B | 12/1978 |
| JP | 55142952 | A | 4/1979 |
| JP | 58048776 | B | 8/1981 |
| JP | 58-048776 | A | 9/1981 |
| JP | 58119950 | A | 1/1982 |
| JP | 58155256 | A | 3/1982 |
| JP | 58155260 | A | 3/1982 |
| JP | 58176446 | A | 4/1982 |
| JP | 58176454 | A | 4/1982 |
| JP | 58222957 | A | 6/1982 |
| JP | 59063350 | A | 10/1982 |
| JP | 59096463 | A | 11/1982 |
| JP | 59192853 | A | 4/1983 |
| JP | 60222547 | A | 4/1984 |
| JP | 59-128958 | A | 7/1984 |
| JP | S59128958 | A | 7/1984 |
| JP | 62267571 | A | 5/1986 |
| JP | 62288354 | A | 6/1986 |
| JP | 62288355 | A | 6/1986 |
| JP | 63243430 | A | 3/1987 |
| JP | 1237346 | A | 3/1988 |
| JP | 2211366 | A | 2/1989 |
| JP | 04-116256 | U | 10/1992 |
| JP | 2002089370 | A | 3/2002 |
| JP | 4116256 | B2 | 7/2008 |
| JP | 2009013965 | A | 1/2009 |
| JP | 2009013965 | A1 | 1/2009 |
| RU | 2192557 | C2 | 11/2002 |
| WO | WO2005012715 | A2 | 2/2005 |
| WO | WO12002888 | A1 | 1/2012 |
| WO | WO12009944 | A1 | 1/2012 |
| WO | WO2013111587 | A2 | 8/2013 |

OTHER PUBLICATIONS

European Office Action for European Application No. 15190351.5-1616, dated Oct. 10, 2017.

Honda Introduces a New Generation of Intelligent General Purpose Engines, PR Newswire [New York] Apr. 20, 2005.

Infineon's Small-Engine Microcontroller Anonymous, Automotive Design & Production; Nov./Dec. 2012, 124, 9. ProQuest, p. 16.

European Search Report for related European Application No. 15190351.5 dated Mar. 9, 2016.

European Search Report for European Application No. 15190351.5-1616, dated May 17, 2017.

Chinese Office Action for Chinese Patent Application No. 201510672511.2, dated Apr. 10, 2018, with Summary.

* cited by examiner

AUTOMATIC STARTING SYSTEM

CROSS REFERENCE TO OTHER APPLICATIONS

This application claims the benefit of U.S. Provisional Application Ser. No. 62/065,426, filed Oct. 17, 2014, which is hereby incorporated by reference in its entirety.

FIELD

This disclosure relates in general to an automatic choke process or system for an internal combustion engine.

BACKGROUND

An inlet manifold of an engine supplies an air and fuel mixture to one or more cylinders of the engine. When more cylinders are included in the engine, the manifold evenly distributes the air and fuel mixture among the multiple cylinders. A carburetor may mix the air and fuel. The carburetor may include an open pipe that passes through to the manifold and includes a venturi shape. That is, the open pipe narrows then widens to increase the speed of the air flowing through the carburetor. To regulate the flow of air a throttle valve, downstream of the venturi shape, may be opened or closed.

In addition, a choke valve at or near the manifold may be used to further regular the ratio of fuel or air. The choke valve may be adjusted to restrict the flow of air, creating a richer fuel to air mixture. The choke valve may be adjusted manually (e.g., by a lever). Some engines may automatically adjust the choke valve through a temperature controlled mechanism. These automatic choke valves are easy for the user to operate. However, temperature alone does not always provide the optimal setting for a choke valve.

BRIEF DESCRIPTION OF THE DRAWINGS

Exemplary embodiments are described herein with reference to the following drawings.

DETAILED DESCRIPTION

A choke valve that is either fully open or fully closed may not provide the best air and fuel mixture for optimal performance. When the engine is hot and running, the optimal position for the choke valve is different that when the engine is hot and stopped. Likewise, when the engine is cold and initially static, the optimal position is different than when the engine is still cold but running. Thus, control of the choke valve based on temperature or running state of the engine alone does not provide the optimal setting for the choke valve and the air and fuel ratio of the engine.

The following examples provide an engine starting system and choke valve that depends on both temperature and running state of the engine. One mechanical linkage is controlled based on temperature, and another mechanical linkage is controlled based on running state. The running state may be detected by air flow directed out of the engine (e.g., from a flywheel and cooling air fan) and onto an air vane. The temperature may be measured by a sensor at a particular location (e.g., engine block, cylinder head, or oil temperature). Alternatively, the temperature may be simulated by a heater that is turned on an off by an electrical signal from the engine (e.g., ignition signal).

Figure 3:
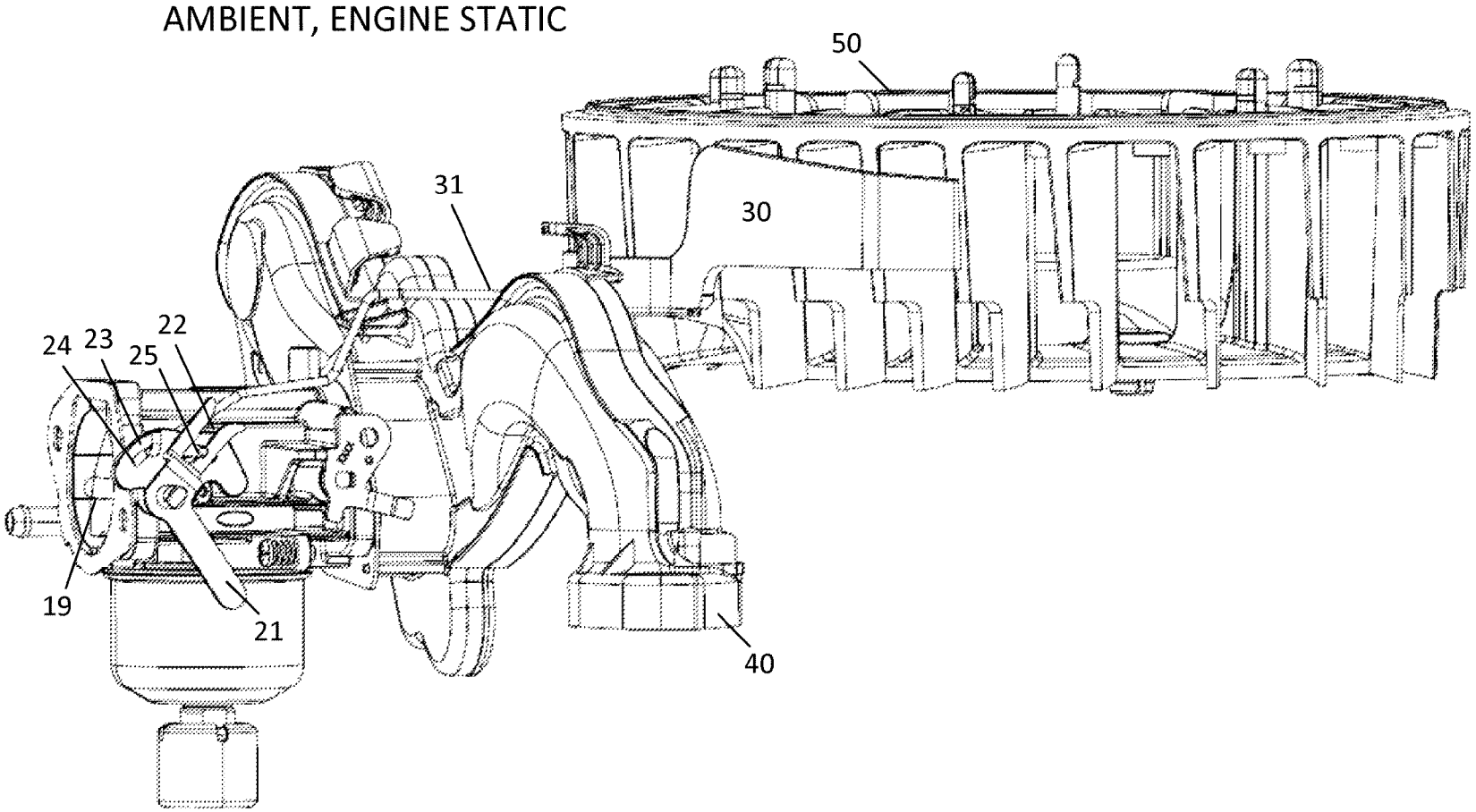
FIG. 3 illustrates the example engine in an ambient temperature and static state.

FIG. 3. illustrates a top view of an engine 10 including a choke assembly 20, an air vane 30, a torsion spring 32, a manifold 40, a flywheel 50, and a chassis 60. The engine 10 may be a small internal combustion engine. Internal combustion engines are used in a variety of devices including, but not limited to, lawn tractors, all-terrain vehicles, chainsaws, lawn mowers, weed trimmers, wood splitters, pressure washers, garden tillers, snow blowers, or other devices. A small engine may be started with a pull cord or a key. The user pulls the pull cord to rotate a recoil pulley or turns a key to initiate a starter and thereby start the engine 10. The engine 10 may be powered by gasoline or a gaseous fuel. The engine 10 may be a two-stroke engine or a four-stroke engine. The size of the engine 10 may vary depending on the application.

The flywheel 60 stores energy from a crankshaft or prime mover of the engine 10, through momentum and inertia, from one or more of the series of strokes and delivers to energy to the crankshaft or prime mover in another one or more of the series of strokes. The flywheel 60 may include fins that act as a cooling fan, distributing air around the engine 10.

The engine 10 may include additional components such a fuel tank, a fuel line, a retractable starter, a starter handle, an air cleaning system, a muffler, a control portion, a governor system, a throttle system, a lubrication system, a user interface, and/or an electronic starter system. The phrases "coupled with" or "coupled to" include directly connected to or indirectly connected through one or more intermediate components. Additional, different, or fewer components may be provided.

The choke assembly 20 may be mounted on the manifold 40. The choke assembly 20 may be connected to a choke valve or choke plate in the intake device (e.g., duct or filter housing upstream of the carburetor) or in the carburetor to control a manifold pressure and/or a ratio of fuel and air that enters the engine 10, for example, through manifold 40. The carburetor is configured to mix fuel and air in a predetermined ratio of fuel to air. If the proportion of fuel to air is too high, a rich fuel mixture, the engine 10 may flood. If the proportion of fuel to air is too low, a lean fuel mixture, the engine 10 may die or be damaged. In order to regulate the ratio of fuel to air, the choke assembly 20 controls the flow of air which creates a pressure drop in the carburetor. A rich fuel mixture is created. When the engine 10 is cold, a rich fuel mixture may be needed to start the engine 10. When the choke is activated, more fuel is drawn, which allows the cold engine to fire once or twice. Then the choke lever is rotated to open the choke plate, which causes the engine 10 to run normally.

Figure 1:
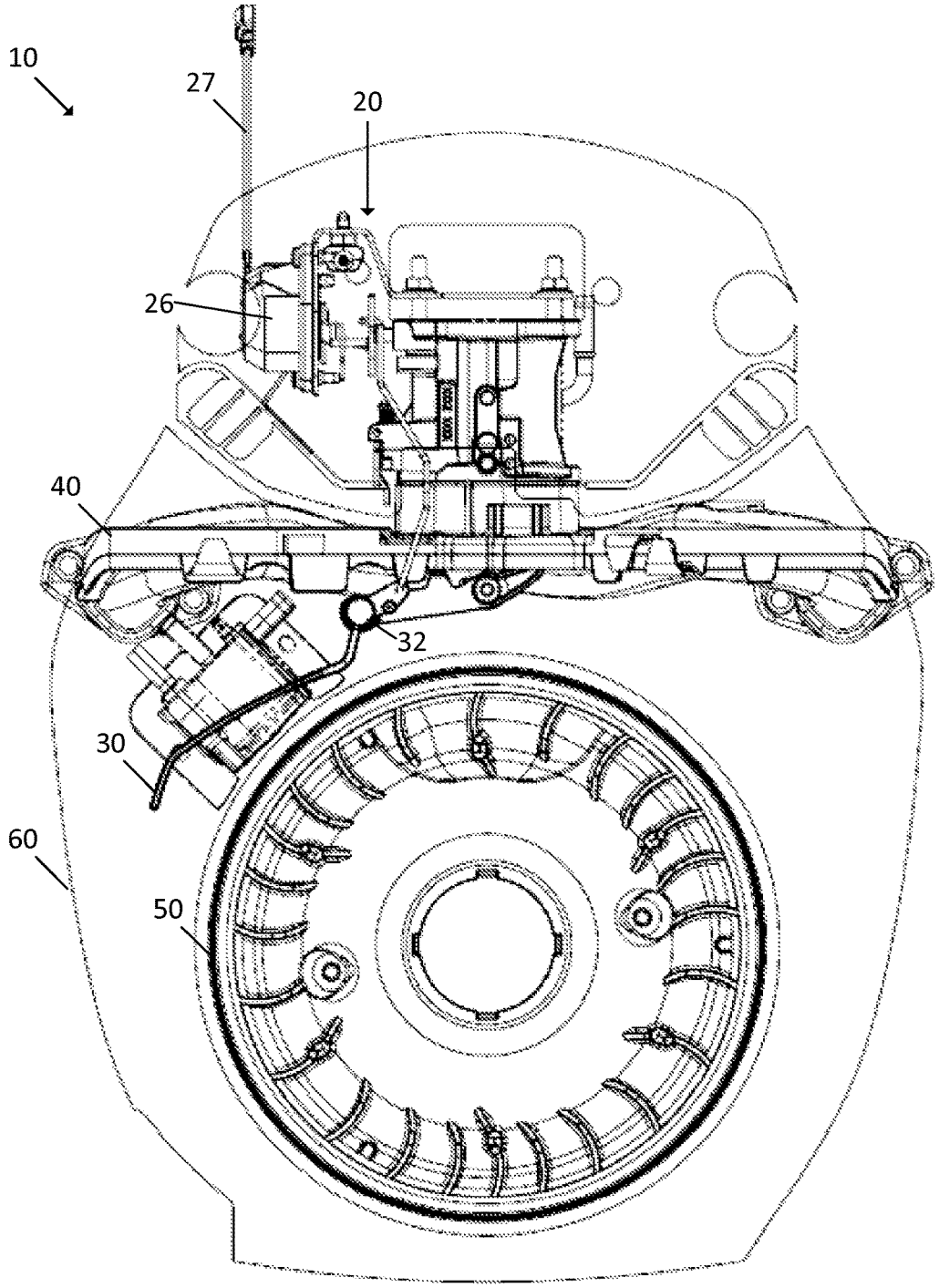
FIG. 1. illustrates a top view of an example engine.
Figure 2:
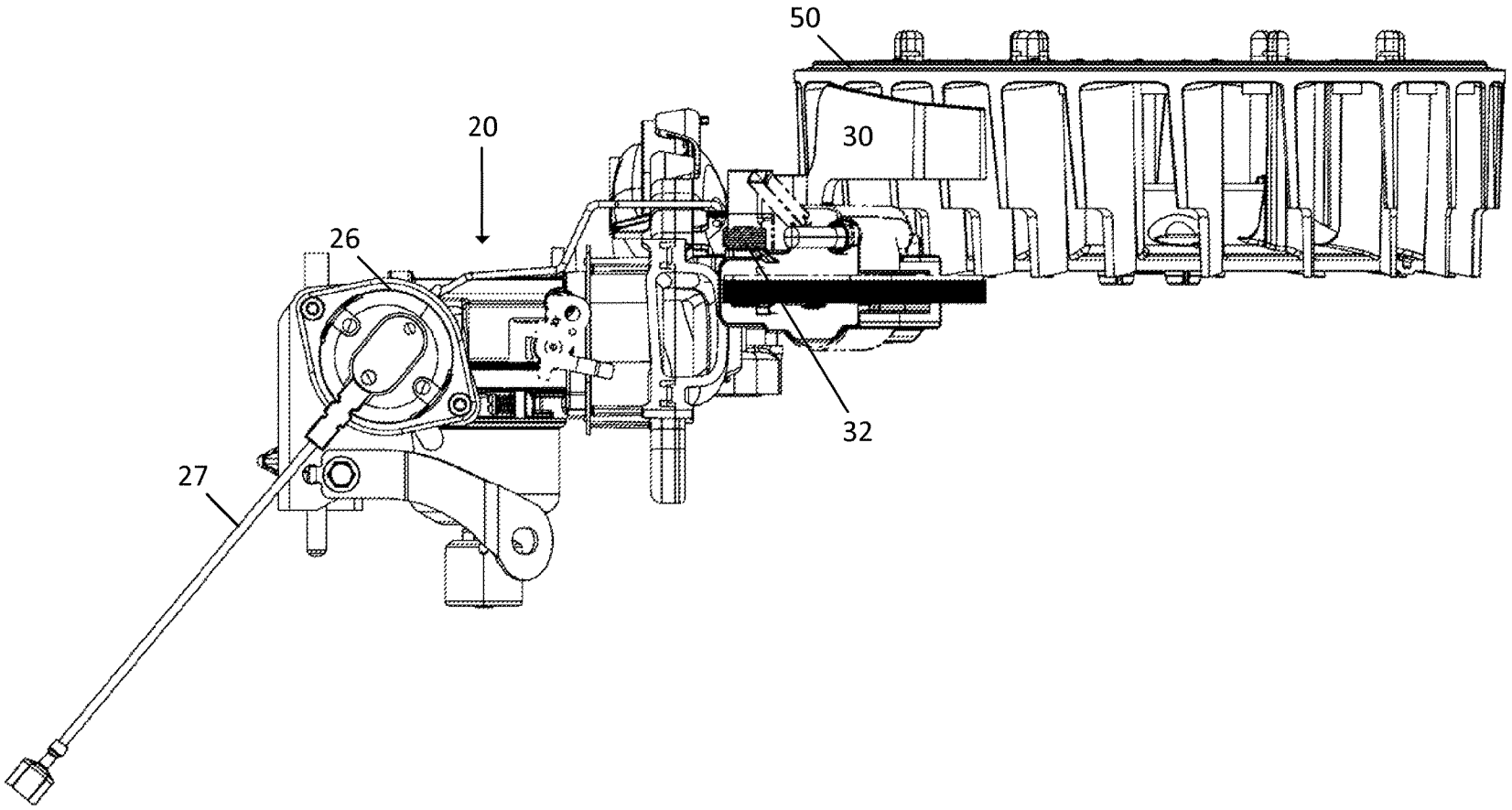
FIG. 2 illustrates a side view of the example engine of FIG. 1.

FIG. 2 illustrates a side view of these portions of the engine 10, including a heat responsive device 26 and an electrical wire 27 or communication path. In one example, the electrical wire 27 connects the heat responsive device 26 to an ignition signal or a sensor signal that controls the operation of a heater. In another example, the electrical wire 27 is connected to a controller that provides a command to control a heater for changing the temperature of the heat sensitive device. The command may be an intermittent control signal that turns the heater on and off. In another example, the heat responsive device 26 may be omitted in favor of a stepper motor to replicate the movement of the heat responsive device 26 without using a heater.

FIGS. 3-6 illustrate states of the choke assembly 20. The choke assembly 20 includes two variably rotating brackets. The first bracket, a control arm 21 is fixedly attached to a shaft of a control device and includes a fork-shaped groove 22. The second bracket, choke arm 23, is fixedly attached to a shaft of a choke plate and includes a semi-circular or linear slot 24. Other shapes for the slot 24 may be used. The choke arm 23 includes a shaft 25 that mates with the groove 22. Accordingly, either one of control arm 21 and choke arm 23 may move to rotate the other one of control arm 21 and choke arm 23, but control arm 21 and choke arm 23 may rotate relative to one another. Thus, multiple positions are possible for the choke plate. In addition, multiple positions are possible for the choke plate for any given position of the air vane 30 and choke arm 23.

With the engine off, the vane 30 moves in one direction (toward the flywheel 50 or to the right in FIGS. 3-6) because there is no or little air flow from the flywheel 50 and the vane 30 may be otherwise biased toward the flywheel 50 such as by a spring or a mounting mechanism of the vane 30. Because the air vane 30 pivots, the linkage 31 is moved to the left. The linkage 31 may move with respect to the slot 24. That is, the linkage 31 may move from a first position (e.g., right side) with the slot 24 to a second position (e.g., left side) within the slot 24. In other words, a first position for the linkage 31 in the slot 24 of the choke arm 23 corresponds to a first running state of the engine 10, and a second position for the linkage 31 in the slot 24 of the choke arm 23 corresponds to a second running state of the engine 10.

In addition, the choke arm 23 may move to the left in the counter clockwise direction under the force of the linkage 31. When the vane 30 moves in the other direction (away from the flywheel 50 to the left in FIGS. 3-6) because there is sufficient air flow from the flywheel 50, the linkage 31 moves to the right. The linkage 31 may move to the middle or left side of the slot 24. In addition, the choke arm 23 may move to the right in the clockwise direction under the force of the linkage 31.

The control arm 21 may be driven by a heat responsive device 26 (e.g., bimetallic spring). When the heat responsive device 26 is heated up, a clockwise torque is applied to the control arm 21, which partially to fully closes the choke plate. When the heat responsive device 26 cools or is at ambient temperature, a counter clockwise torque is applied to the control arm 21, which partially to fully opens the choke plate.

Depending on the combination and relative positions of control arm 21 and choke arm 23, the choke may be placed in a predetermined number of positions between fully open and fully closed. The number of positions between open and closed may be 2, 3, 4, or another number. While movements of the linkage 31, control arm 21, and choke arm 23 are described with directional indicators such as clockwise, counterclockwise, left, and right, the choking system may be arranged in another configuration in which the opposite direction or different direction of the linkage 31, control arm 21, and choke arm 23, as well as related components, achieve the same or a similar operation.

Figure 5:
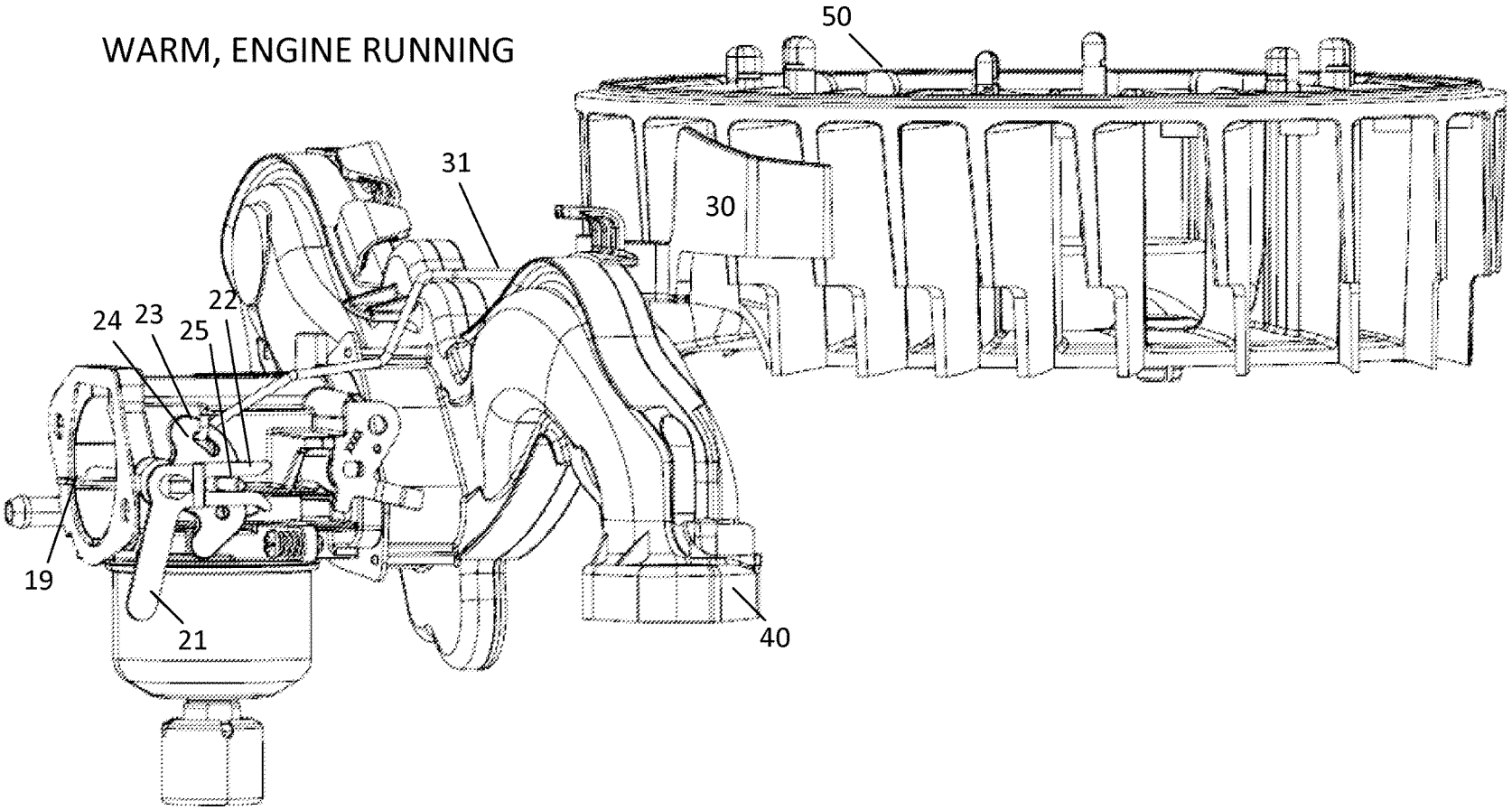
FIG. 5 illustrates the example engine in an increased temperature and running state.
Figure 6:
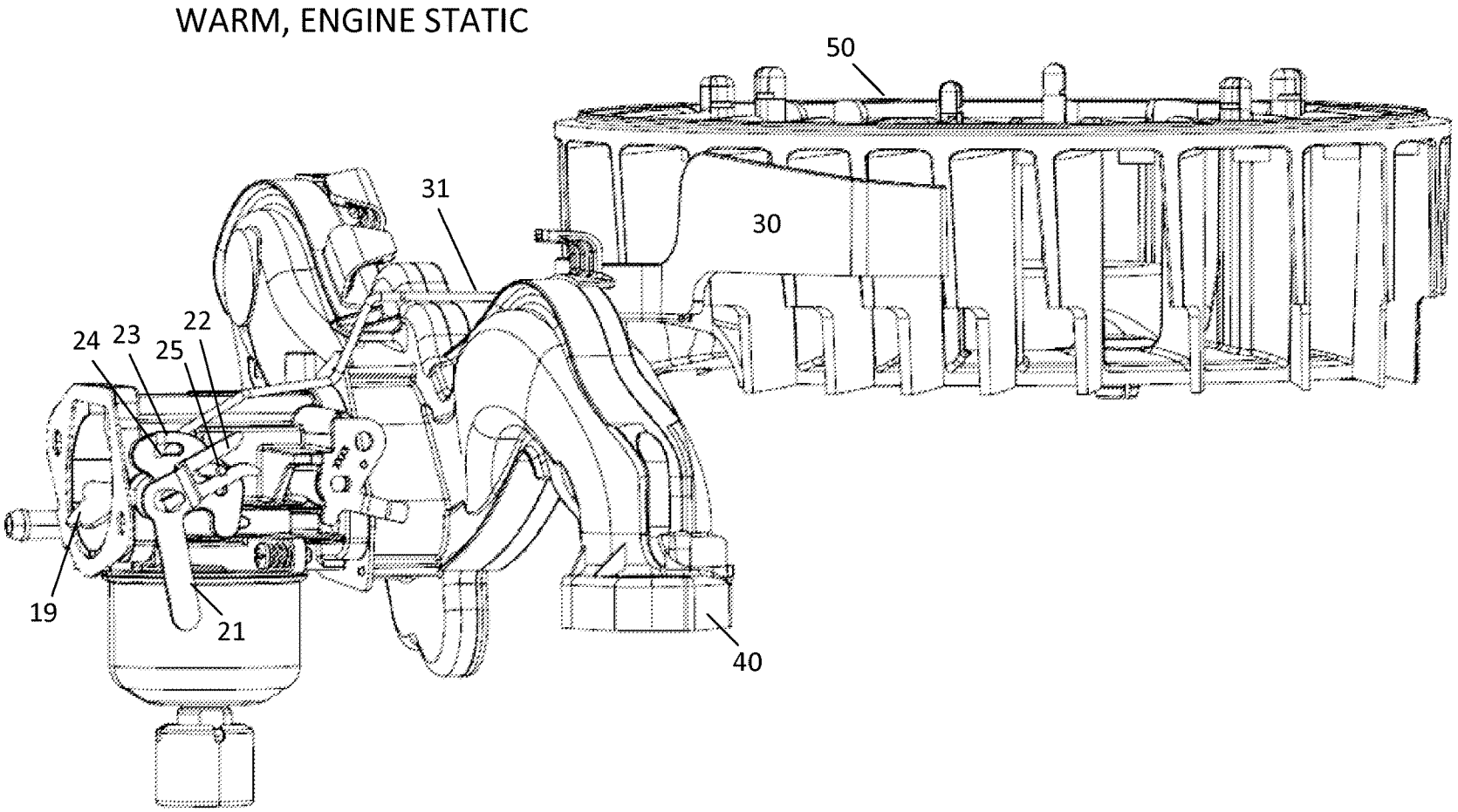
FIG. 6 illustrates the example engine in an increased temperature and has stopped state.

As described in more detail below, the multiple positions for the choke valve include a first position that corresponds to an ambient temperature and a stopped state of the engine (FIG. 3), a second position that corresponds to the ambient temperature and a running state of the engine (FIG. 4), a third position that corresponds to an increased temperature and the running state of the engine (FIG. 5), and a fourth position that corresponds to the increased temperature and the stopped state of the engine (FIG. 6).

Figure 12:
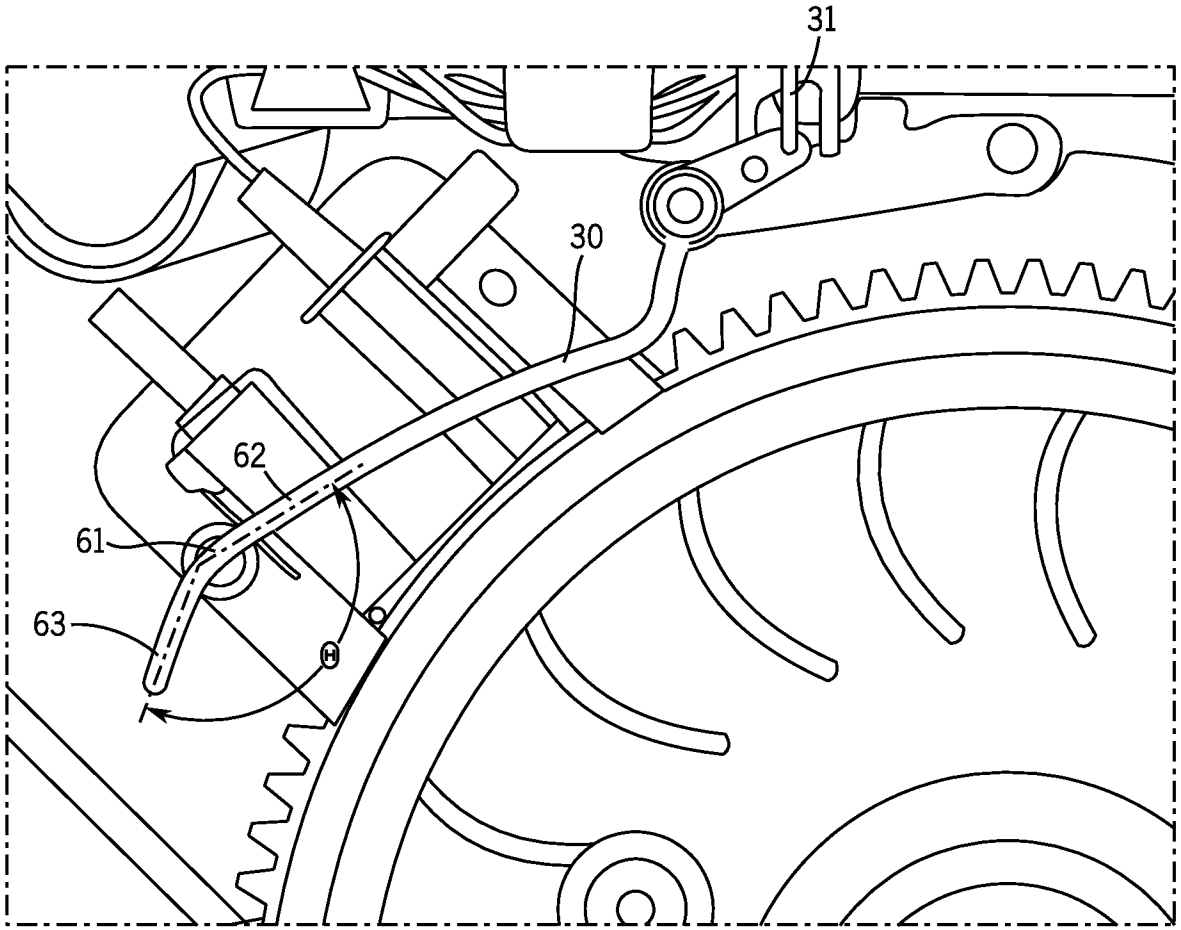
FIG. 12 illustrates an example placement of the air vane.

FIG. 3 illustrates a state where the engine 10 is in an ambient or cold temperature and the engine is static or stopped. A torsion spring or another biasing mechanism holds the vane 30 in the direction of the flywheel 50. Accordingly, the linkage 31 may receive a force to move left from the pivoting nature of the vane 30 and connection for the linkage 31, as shown in FIG. 12. However, the linkage 31 is positioned on the right side of the slot 24 because of a rotation of the control arm 21. Because the engine 10 is cold, the heat responsive device 26 applies a counter clockwise torque to the control arm 21. (which may be in addition to the force from the linkage 31 through slot 24) and fully close the choke plate (e.g., choke valve 19).

Figure 4:
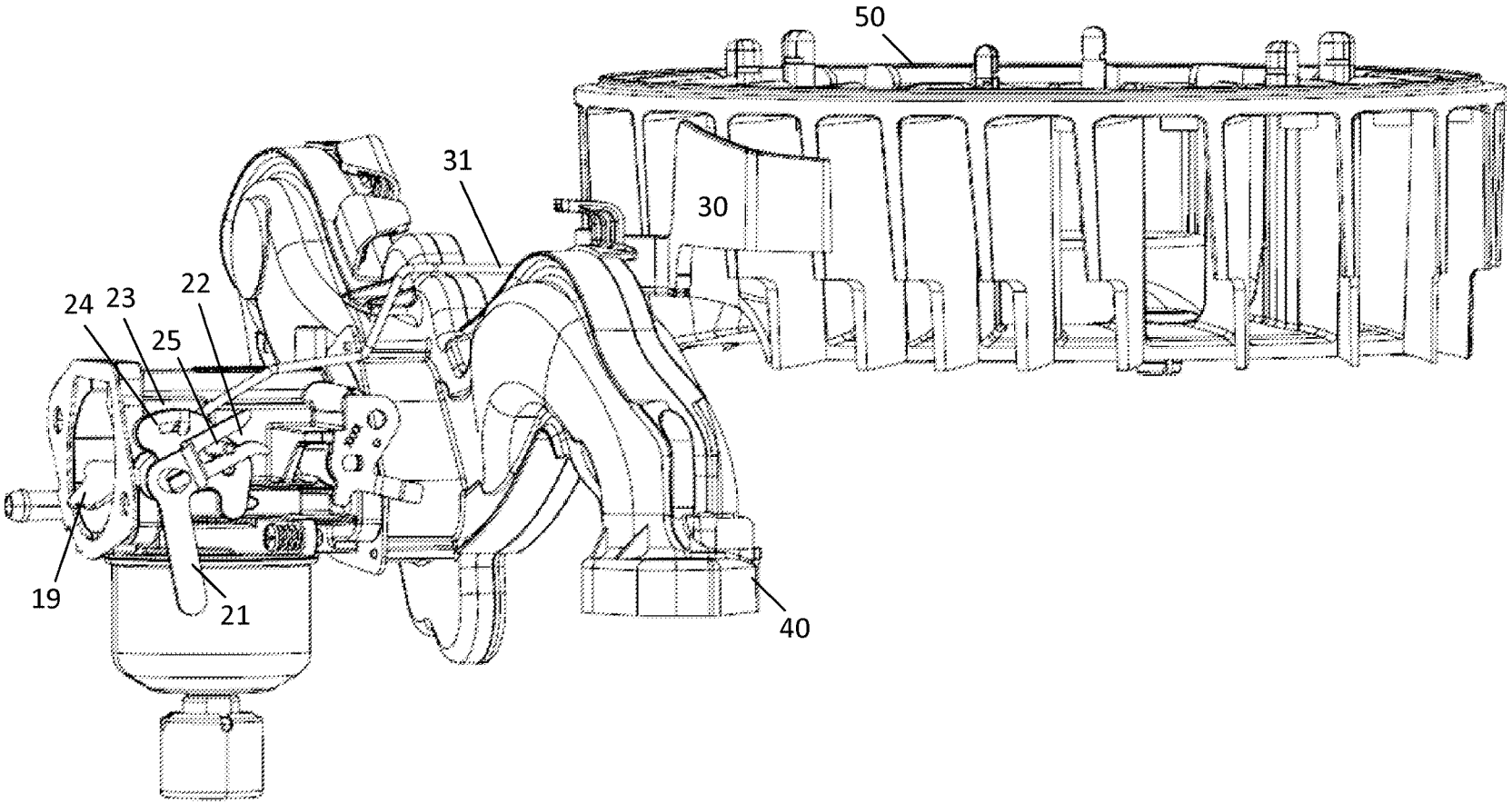
FIG. 4 illustrates the example engine in an ambient temperature and running state.

FIG. 4 illustrates a state in which the engine 10 has started running but remains at ambient temperatures. Because the engine 10 is running, air from the flywheel 50 moves the air vane 30 away from the flywheel 50, or to the left. The pivoted linkage 31 may receive a force to the right. The linkage 31 may be on the right side of the slot 24. The force causes the choke arm 23 to rotate in the clockwise direction, rotating the choke plate to a first partial open position (e.g., in the range of 30%-60%, or specifically 40% open, or 50% open). The first partial open position may be a cold run position.

FIG. 5 illustrates a state in which the engine 10 has increased in temperature and is running. Because the heat responsive device 26 has been heated to a higher temperature, the heat responsive device 26 applies a clockwise torque to the control arm 21 to rotate the choke plate to an open position. The heat responsive device 26 may be heated by a thermistor or through another technique. The linkage 31 moves to the left side of the slot 24. The air vane 30 has not substantially changed positions. Because the linkage 31 position between the air vane 30 and the choke arm 23 are variable, the choke plate moves to the open position under the force of the heat responsive device 26 and the control arm 21, and the linkage 31 slides to the left side of the slot 24.

FIG. 6 illustrates a state in which the engine 10 has increased in temperature and has stopped running. Because the engine 10 is not running, the air vane 30 under the torsion spring 32 moves toward the flywheel 50, or to the right, and the pivoted linkage 31 may receive a force to the left, sliding to the left side of the slot 24. The force, originating with the torsion spring 32, applies sufficient load to rotate the choke arm 23 and the choke plate to a second partial open position (e.g., in the range of 50%-80%, or specifically 60% open, or 70% open). The second partial open position may be a warm restart position for improved warm/hot engine restarts.

The length, or another dimension, of the slot 24 may be calibrated or selected in order to set a percentage open of the choke plate for the first partial open position and a percentage open of the choke plate for the second partial open position. The size of the slot 24 may be changed using spacers or during manufacturing. The coefficient of elasticity for the spring 32 biasing the air vane 30 may be calibrated or selected in order to set a percentage open of the choke plate for the first partial open position and a percentage open of the choke plate for the second partial open position. The angle between the fork-shaped groove 22 and the heat responsive device 26 and/or the angle between the choke arm 23 and the slot 24 may be calibrated or selected in order to set a percentage open of the choke plate for the first partial open position and a percentage open of the choke plate for the second partial open position. The length of the groove 22 may be calibrated or selected in order to set a percentage open of the choke plate for the first partial open position and a percentage open of the choke plate for the second partial open position. The size of the groove 22 may be changed using spacers or during manufacturing. The position of the shaft 25 on the choke arm 23 may be calibrated or selected in order to set a percentage open of the choke plate for the first partial open position and a percentage open of the choke plate for the second partial open position.

Figure 7:
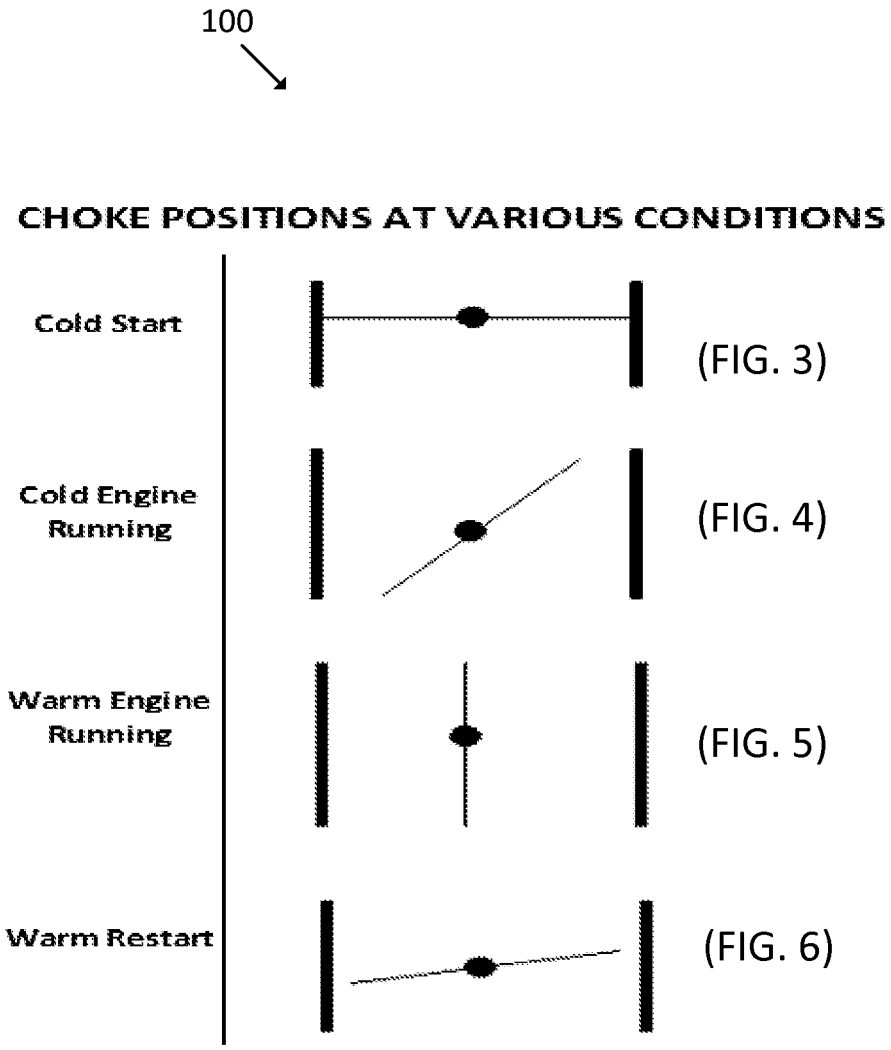
FIG. 7 illustrates an example chart of choke plate positions for an engine.

FIG. 7 illustrates a chart 100 of choke plate positions. The positions may correspond to any of the states above, but example correlations are listed on the chart 100. Various percentages of fully open may correspond to the cold engine running state such as 40-45%, and various percentages of fully open may corresponds to the warm restart such as 60-60%. In one example, a ratio of the choke open percentage for the cold engine running state to the warm restart is 0.5 to 0.8. In one example, the ratio is 0.6.

Figure 8:
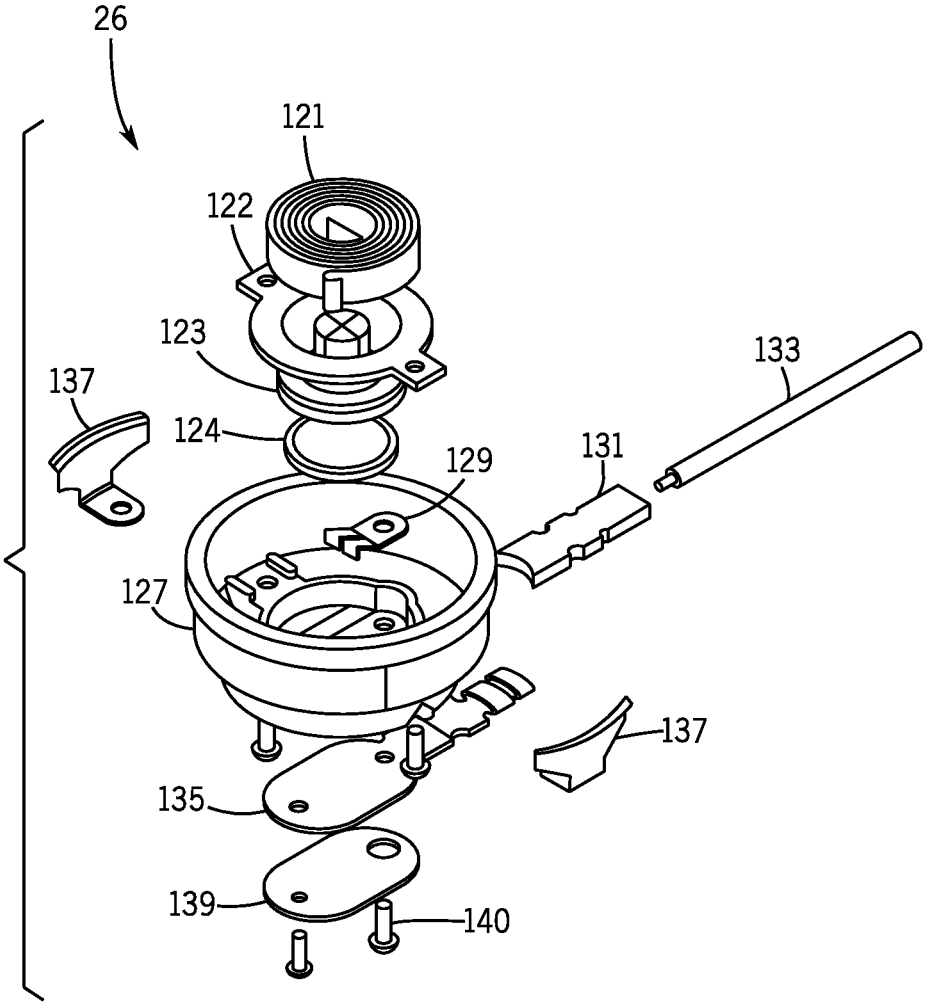
FIG. 8 illustrates an example heat-responsive device.

FIG. 8 illustrates the heat-responsive device 26 including a thermostatic spring 121, a retainer 122, a stud 123, a heater 124, a plastic housing 127, a contact spring 129, a cover 131, a wire 133, a power terminal 135, a grounding terminal 137, and an insulating cover 139. Additional, different or fewer components may be included.

The thermostatic spring 121 is made of at least two metals (bimetal). The two metals may include an active thermally expanding metal and a low expanding metal. The active thermally expanding layer may be an alloy of nickel, iron, manganese or chrome, and the low expanding metal may be iron and nickel alloy. In one example, an intermediate later (e.g., nickel or copper) is between the active thermally expanding metal and the low expanding metal in order to increase the electrical conductivity of the thermostatic spring 121. The thermostatic spring 121 converts temperature change into a mechanical displacement (rotation) because the two metals expand at different rates or magnitudes when heated. The mechanical displacement may be linear, or higher order, across a temperature range. A mechanical displacement may be highest at a threshold temperature (e.g., 270° F.).

The heater 124 may be a ceramic heater or resistor heated under an electric current from a wire to change the temperature of the heat-responsive device. The wire may carry an electrical current associated with ignition or a sensor. The sensor may be a temperature sensor that detects the temperature of the engine block, a cylinder or oil. The sensor may be an ignition sensor that detects when the ignition of the engine 10 is turned on. The sensor may be an oil pressure sensor. For example, when the engine 10 is running, oil pressure is generated, causing the oil pressure sensor to trigger an electrical current, which heats the resistor and causes a mechanical displacement in the thermostatic spring 121. In one example, rather than a sensor the wire may be connected to accessory power line from the batter that is on when the ignition is turn on.

The retainer 122 includes one or more holes for receives screws or nails for securing the stud 123 and heater 124 to the plastic housing 127. The retainer may be formed of a heat conductive material. The stud 123 transfers heat from the heater 124 to the thermostatic spring 121. The thermostatic spring 121 is pressed into a cross-shaped slot in the stud 123 to physically retain the thermostatic spring 121.

The heater 124 may operate on a voltage level (e.g., 12 volts) of direct current (dc) to provide heat to the thermostatic spring 121. The contact spring 129 connects to the terminal 135, which provides direct current (dc) through a rivet 140 and/or a wire 133. The wire may be physically coupled with the contact spring 129. The contact spring 129 expands as temperature increases. Alternatively, the cover 131 electrically insulates the terminal 135 and wire 133. The wire 133 may be soldered to the heater 124 or the terminal 135 may be soldered to the heater 135.

The power terminal 135 may be connected to a positive terminal of the battery of the engine 10. Alternatively, the power terminal 135 may be connected to another battery source in order to isolate the heat responsive device 26 from the other electrical systems of the engine. The grounding terminal 137 may be connected to the chassis 60 or a negative terminal of the battery of the engine 10. The grounding terminal 137 may be physically connected to the heat responsive device 26 using rivets or a screw, which may be used to secure the insulating cover 139.

Figure 9:
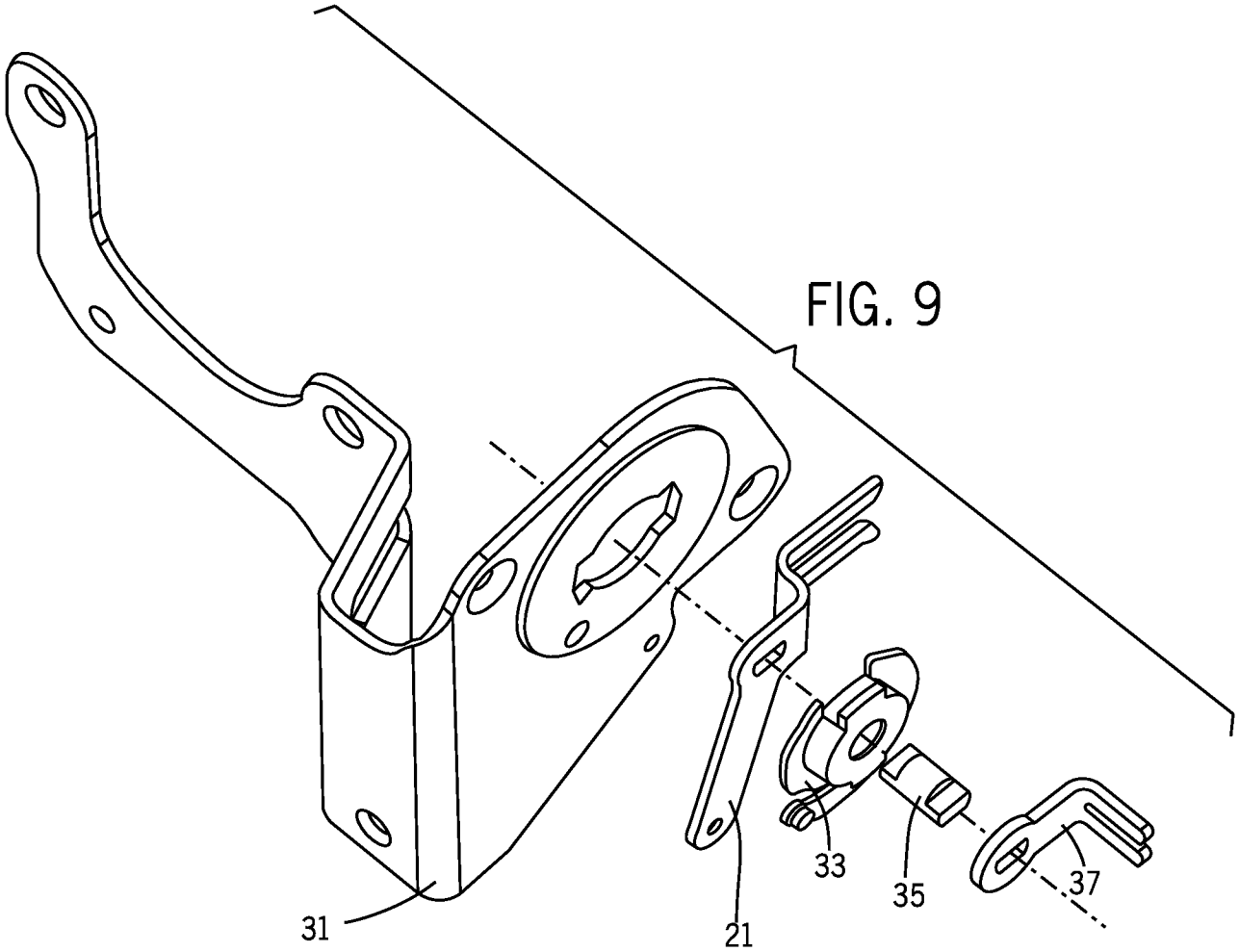
FIG. 9 illustrates an example mounting device and control arm.

FIG. 9 illustrates mounting of the control arm 21. The frame 34 receives a shaft 35 that secures the control arm 21, small fork 37, and bushing 33. The shaft 35 snaps in and rotates into place. The small fork 37 connects to the heat-responsive device 26 above. The bushing 33 acts as a bearing surface that absorbs thrust and reduces the friction when rotating the control arm 21.

Figure 10:
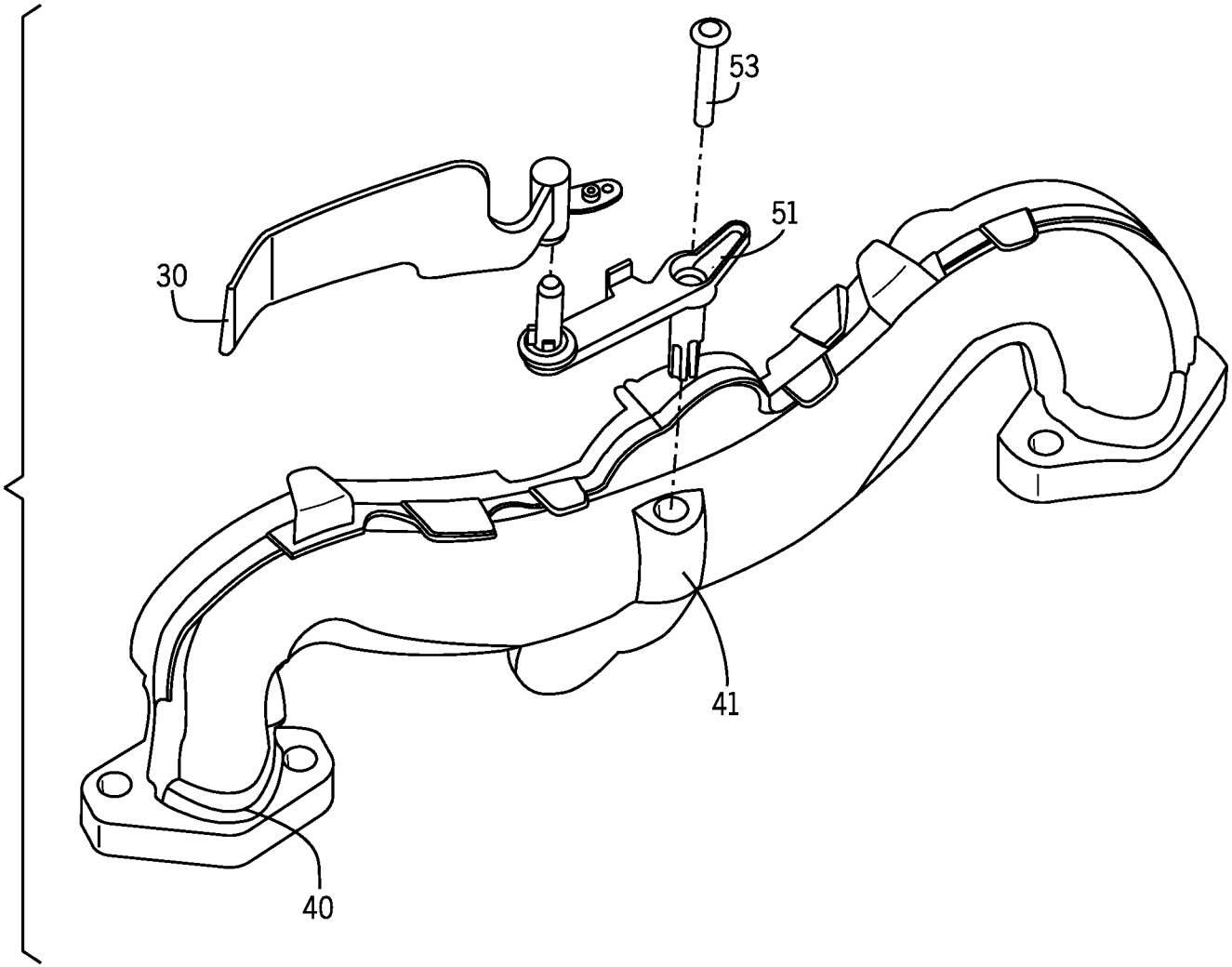
FIG. 10 illustrates an example manifold and air vane.
Figure 11:
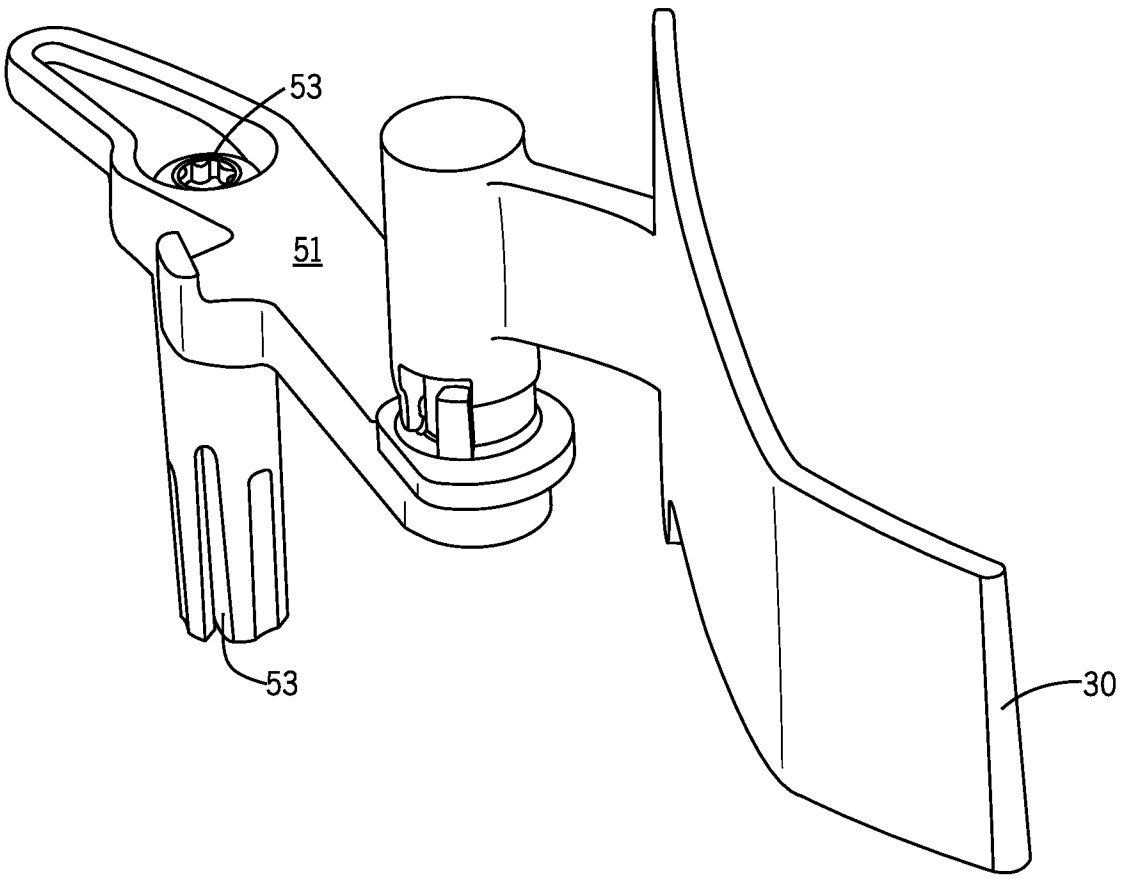
FIG. 11 illustrates another example air vane.

FIG. 10 illustrates mounting of the air vane 30 on the manifold 40. A pivoting member 51 supports the air vane 30. An expandable fastener 53 is inserted into an elongated recess in the pivoting member after the pivoting member 51 is mated with a hole 41 of the manifold 40. The expandable fastener 53 operates similarly to a wall anchor. The expandable fastener 53 expands the inserted portion of the pivoting member 51 inside hole 41 to secure the assembly to the manifold 40. FIG. 11 illustrates the expandable fastener 53 installed inside the pivoting member 51.

FIG. 12 illustrates placement of the air vane 30. The air vane 30 may have a variety of shapes and sizes. To move significantly at lower engine speeds, the air vane 30 may have an angled portion 61 in order to create additional lift from the air flow from the engine 10. The angled portion 61 creates an angle Θ between a longitudinal section 62 and a tip section 63. The angle may be any obtuse angle such as 120-170 or 140-150 degrees (e.g., 143 degrees). The angled portion 61 tips the end portion of the air vane 30 toward the engine, creating addition lift. The angle may be set according to the application of the engine 10. For example, at low speed or revolutions per minute (RPM) applications the angle may be adjusted to increase the angle and at high speeds or RPM applications the angle may be adjusted decrease the angle. The air vane 30 may include an adjustable connection (e.g., pivot axis secured by a wingnut) between the angled portion 61 and the tip section 63 such that the user may make the adjustment of the angle manually.

Figure 13:
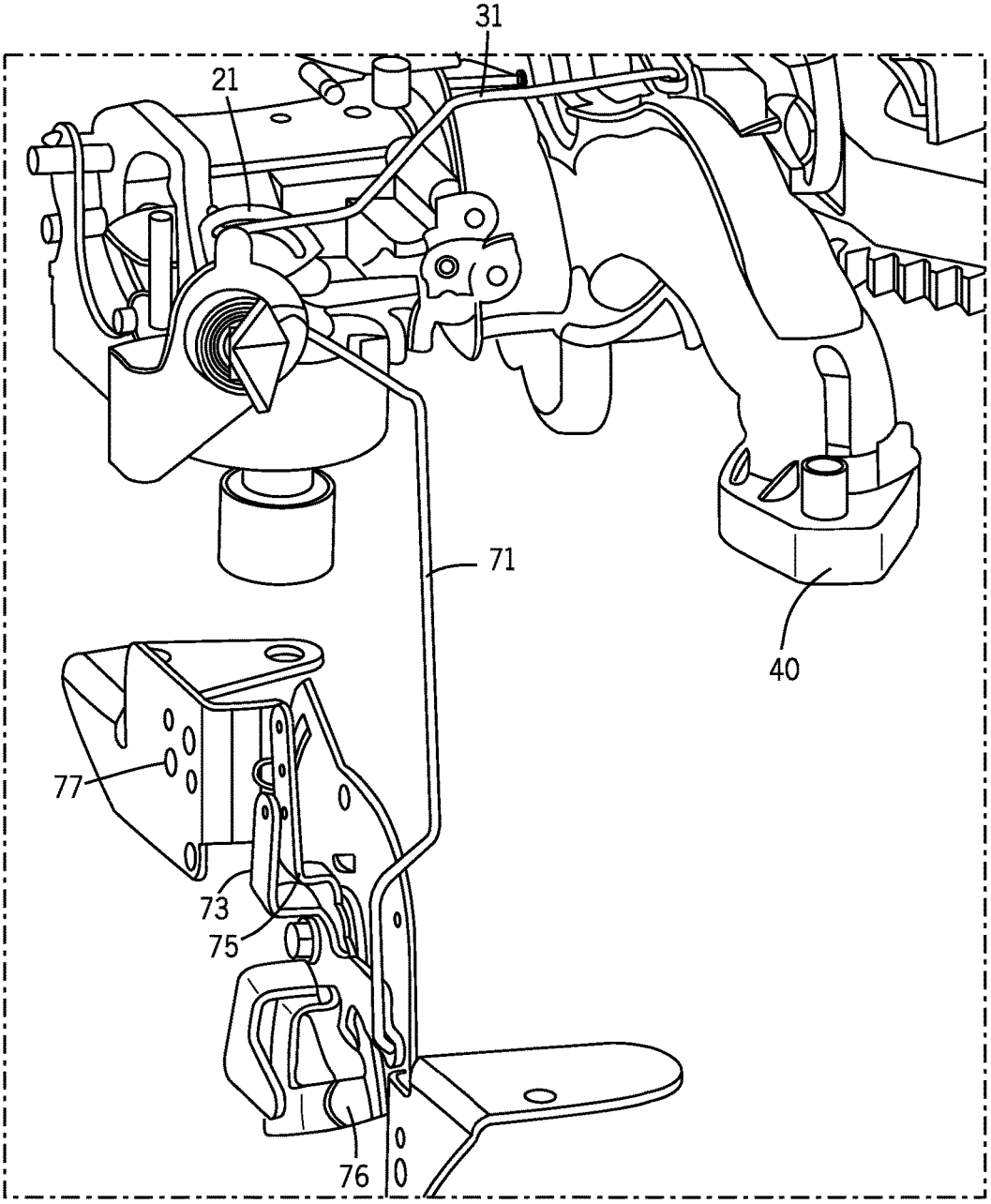
FIG. 13 illustrates an example manual override mechanism.

FIG. 13 illustrates an example manual override mechanism for the choke system. The override mechanism includes a choke override link 71, an intermediate lever 73, a throttle lever 75, a choke off level 76, and a mounting bracket 77. The mounting bracket 77 may be integral with chassis 60. Additional, different, or fewer components may be included.

The choke override link 71 is connected to the choke arm 23, as shown in FIG. 3. When the choke override link 71 is actuated (e.g., moved up vertically), which rotates the choke arm 23 counterclockwise, overriding the effect of the vane 30 and/or the thermostatic spring 121.

The user may operate the throttle lever 75. The choke on lever 76 contacts the intermediate lever 73. When the throttle lever 75 is moved counterclockwise, as shown in FIG. 13, choke on lever 76 contacts intermediate lever 73 and override link 71 is actuated to rotate choke arm 23 to close the choke valve 19. In the run position, with the choke off, the choke on lever 76 moves away from the intermediate lever 73, which allows the automatic choke to function normally.

Figure 14:
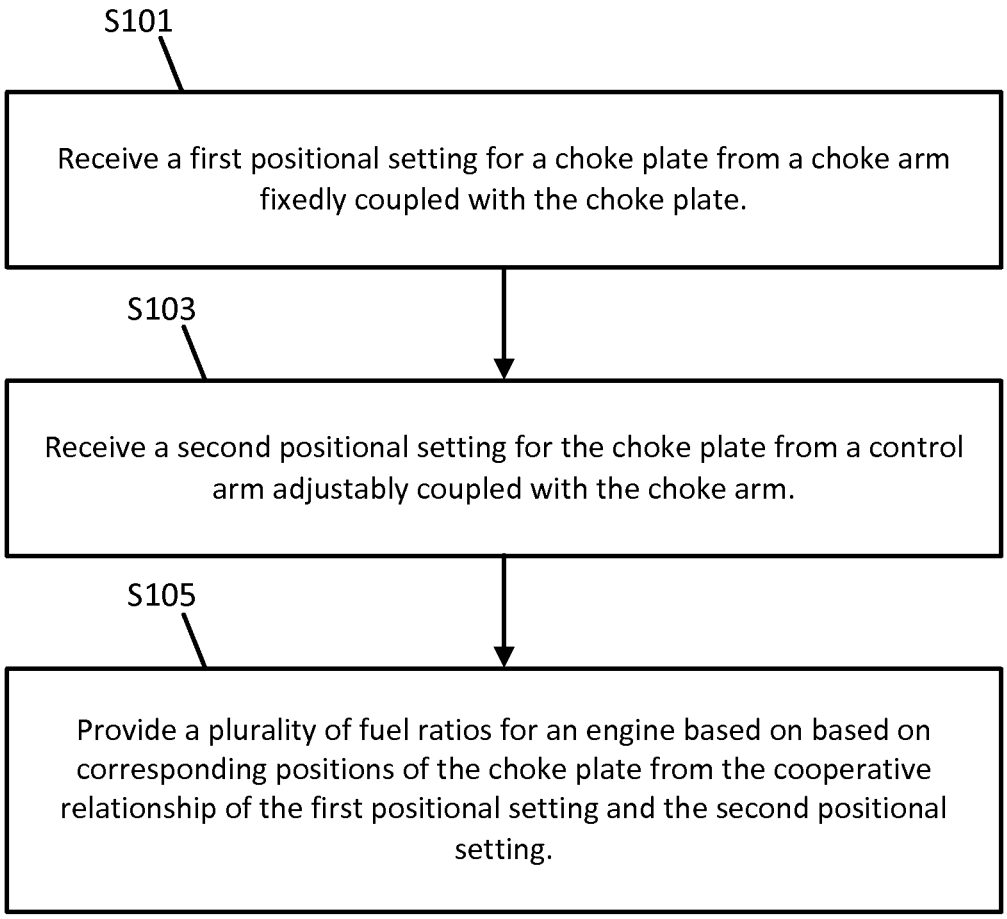
FIG. 14 illustrates an example flow chart for operating the automatic starting system.

FIG. 14 illustrates an example flow chart for operating the automatic starting system. Additional, different, or fewer acts may be performed.

At act S101, a choke mechanism (e.g., choke plate or choke valve) receives a first positional setting for the choke mechanism from a choke arm fixedly coupled with the choke mechanism. The first positional setting biases the choke mechanism in a particular direction. The first positional setting may define a range of motion for the choke arm. The range of motion may be defined by a slot or groove in the choke arm that is mated with a linking rod from an air vane. The range of motion for the choke is modified by movement of the linking rod and the air vane.

At act S103, the choke mechanism receives a second positional setting for the choke mechanism from a control arm adjustably coupled with the choke arm. The control arm moves the choke arm with the range of motion defined in act S101. The control arm may be coupled to a rotational driving mechanism. The rotational driving mechanism may provide a first rotational force to the choke arm and/or the choke mechanism and a second rotational force to the choke arm and/or the choke mechanism. The first rotational force is opposite the second rotational force.

The rotational driving mechanism may be a bimetallic spring associated with a heater. As the bimetallic spring receives more heat from the heater, the first rotational force is applied, and as the bimetallic spring receives less heat from the heater, the second rotational force is applied. Based on the degree of the first rotational force and the second rotational force the choke mechanism is rotated to a particular angle selected from multiple angles or a range of angles.

At act S105, the choke mechanism provides multiple fuel to air ratios based on the multiple angles or range of angles. The multiple fuel to air ratios are based on corresponding positions of the choke mechanism from the cooperative relationship of the first positional setting and the second positional setting. One position of the choke mechanism may correspond to a fully open and another position may correspond to fully closed. The positions of the choke mechanism may include one or more intermediate positions. Several intermediate positions may be included.

In one example, the positions of the choke position may include a first position that corresponds to an ambient temperature and a stopped state of the engine, a second position that corresponds to the ambient temperature and a running state of the engine, a third position that corresponds to an increased temperature and the running state of the engine, and a fourth position that corresponds to the increased temperature and the stopped state of the engine.

Figure 15:
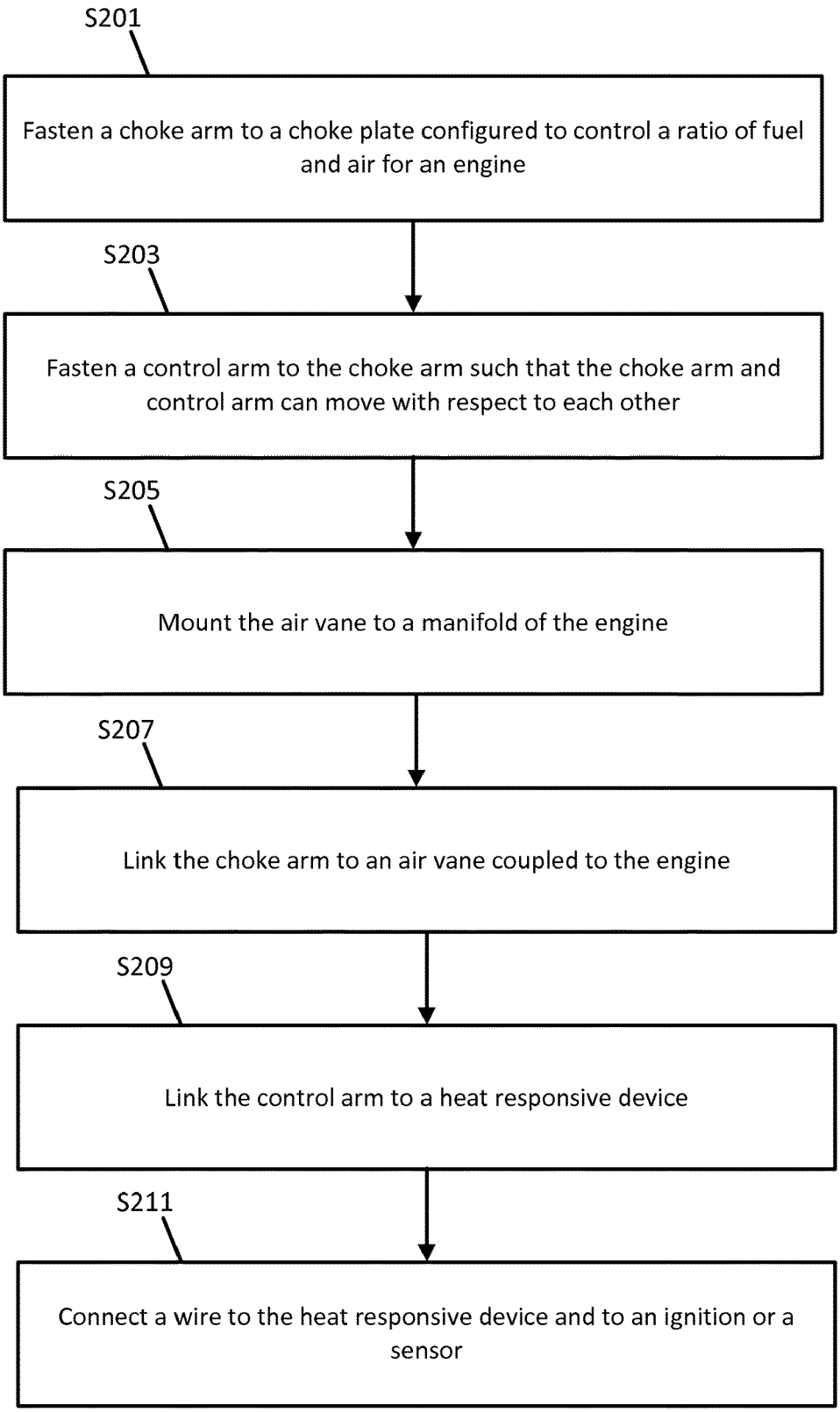
FIG. 15 illustrates an example flow chart for manufacturing the automatic starting system.

FIG. 15 illustrates an example flow chart for manufacturing the automatic starting system. Additional, different, or fewer acts may be performed.

At act S201, a choke arm is fastened to a choke plate configured to control a ratio of fuel and air for an engine. The choke arm may be a circular disk or a semi-circular disk. However, the choke arm may take a variety of shapes. Any shape may be used that allows space to rotate about along with a shaft of a choke mechanism (e.g., choke plate or choke valve). The choke arm may be made from a plastic material (e.g., an acetal homopolymer) which has low friction properties, sufficient strength and stiffness for the temperature environment, is dimensionally stable and economical. The molded plastic arm includes a shaft 25 (drive pin) to mate with the forked lever. Alternatively, the choke arm may be made from steel with zinc plating, and may include a separate drive pin fastened to the arm (riveted or stud welded).

At act S203, a control arm is fastened to the choke arm such that the choke arm and control arm can move with respect to each other. The control arm and the choke arm are operable to cooperate to move the choke plate into a plurality of positions. In one example, the control arm includes a hole or grove, and the choke arm includes a protrusion or shaft that moves along the hole or grove in the control arm. The control arm may have an "L" shape or a "V" shape. One leg of the shape may correspond to the hole or grove, and another leg of the shape may connect to a manual override.

The control lever may be slotted to allow for the offset of shaft centerlines between the choke shaft and the control lever shaft. The system is designed to amplify the rotation of the thermostat coil rotation (e.g., about 45 degrees coil rotation results in about 75 degrees choke plate rotation). The control lever 21 is "L" shaped as an assembly aid. The assembler uses the lever (marked 21) to rotate the control lever 21 (approximately horizontal) to align the slot 22 with shaft 25 as the automatic choke control assembly is installed on the carburetor (left to right as shown in FIG. 3). The slot (e.g., groove 22) could be a closed slot and the control lever could be straight if and alternative assembly process could be use, e.g. the choke assembly could be installed into the page as shown in FIG. 3.

At act S205, the air vane is mounted to a manifold of the engine. The air vane may be mounted directly to the manifold. For example, the air vane may include a mounting rod that is mounted in a hold of the manifold (e.g., as shown in in FIG. 10). The air vane may be mounted to the manifold through a pivoting device. The pivoting device may include a first mounting rod for mounting the pivoting device on the manifold. The pivoting device may include a second mounting rod for mounting the air vane on the mounting device. The pivoting device may allow two degrees of motion for the air vane. That is, the air vane may rotate with respect to the pivoting device via the second mounting rod, and the pivoting device may rotate with respect to the manifold via the first mounting rod. Alternatively, one or both of the first and second mounting rods may be replaced with a recess that mates with a convex portion of the manifold or the air vane, respectively.

At act S207, the choke arm is linked to an air vane coupled to the engine. In one example, a rod extends from the choke arm to the air vane. In another example, the choke arm and air vane are linked through a sequence of levers, pinions, and/or gears to rotate the choke arm. Any connection that allows the air van to translate forward and backward motion to the choke arm.

At act S209, the control arm is linked to a heat responsive device. The control arm may be linked with a rivet, screw, or snap fit connection to the heat responsive device. At act S211, a wire is connected to the heat responsive device and to an ignition or a sensor.

The choke system may be initialized or configured in order to tune the positions of the choke valve. Various positions or angles for the choke valve may be optimal in different stage of starting or running the engine. In order to determine whether the operation is optimal, several quantities may be measured. For example, an air to fuel ratio may be measured by a zirconia oxygen sensor or O2 sensor, an efficiency of the engine may be measured using a combination of a temperature sensor and a tachometer, or a stoichiometry of the engine may be measured by a lean mixture sensor. Based on the measured quantities, one or more adjustments may be made to the choke system. Example adjustments may include the size of the slot or groove in the choke arm 23 (e.g., slot 24) may be changed using spacers or an adjustable pin, the size of the groove in control arm 21 (e.g., groove 22) may be changed using spacers or an adjustable pin, and the angle Θ may be changed by adjusting the longitudinal section and tip section of the air vane 30. The adjustable pins may be connected to plates that slide into the grooves or slots to reduce the sizes of the grooves or slots.

The choke system may be adjusted based on the model number or the application, which may be referred to as enrichment calibration. Through enrichment calibration, an engine used on a snow blower may require the choke be more closed for the ambient running condition than a summer lawn mowing tractor. Some engines require the choke to remain on longer than another due to the combustion chamber shape, intake manifold runner size or length, camshaft timing, carburetor venturi size (e.g., oversized venturi provides better vacuum signal to pull fuel out of the bowl).

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

In the foregoing Detailed Description, various features may be grouped together or described in a single embodiment for the purpose of streamlining the disclosure. It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

We claim:

1. An apparatus comprising:

a choke plate configured to control a ratio of fuel and air for an engine;

a choke arm fixedly coupled with the choke plate;

a control arm adjustably coupled with the choke arm; and a heat responsive device configured to apply at least one torque to the control arm according to a sensor that detects whether the engine is running, wherein the control arm and the choke arm cooperate to move the choke plate into a plurality of positions in response to the heat responsive device.

2. The apparatus of claim 1, wherein the plurality of positions include a fully open position, a fully closed position and at least one intermediate position.

3. The apparatus of claim 2, wherein the at least one intermediate position includes two intermediate positions.

4. The apparatus of claim 1, further comprising:

a slot integrated with the choke arm; and a shaft integrated with the control arm, wherein the plurality of positions of the choke plate correspond to relative positions of the slot and the shaft.

5. The apparatus of claim 1, further comprising:

an air vane responsive to airflow from a flywheel and coupled with the choke arm.

6. The apparatus of claim 5, wherein the air vane is rotatably mounted on a manifold of the engine.

7. The apparatus of claim 5, further comprising:

a linkage device coupling the air vane and the choke arm, wherein is the linkage is slidably engaged with a slot in the choke arm.

8. The apparatus of claim 7, wherein a first position for the linkage in the slot of the choke arm corresponds to a first running state of the engine, and a second position for the linkage in the slot of the choke arm corresponds to a second running state of the engine.

9. The apparatus of claim 7, wherein at least one dimension of the slot in the choke arm is selected to define one or more of the plurality of positions of the choke arm.

10. The apparatus of claim 1, wherein the heat responsive device at a first temperature applies a first torque tending to close the choke plate via the control arm, and the heat responsive device at a second temperature applies a second torque.

11. The apparatus of claim 1, wherein the heat responsive device is a bimetallic device.

12. The apparatus of claim 11, wherein the heat responsive device comprises:

a heater for changing the shape of the bimetallic device.

13. The apparatus of claim 12, wherein the heater is electrically connected to an ignition of the engine.

14. The apparatus of claim 1, wherein the plurality of positions include a first position that corresponds to an ambient temperature and a stopped state of the engine, a second position that corresponds to the ambient temperature and a running state of the engine, a third position that corresponds to an increased temperature and the running state of the engine, and a fourth position that corresponds to the increased temperature and the stopped state of the engine.

15. The apparatus of claim 1, wherein the heat responsive device includes a heater that receives a current from the sensor.

16. An apparatus comprising:

a choke plate configured to control a ratio of fuel and air for an engine;

a choke arm fixedly coupled with the choke plate; and a control arm adjustably coupled with the choke arm;

a heat responsive device configured to apply at least one torque to the control arm, wherein the heat responsive device is a bimetallic device, wherein the control arm and the choke arm cooperate to move the choke plate into a plurality of positions a heater for changing the shape of the bimetallic device, wherein the heater is electrically connected to a temperature sensor or an oil pressure sensor.

17. A method comprising:

receiving a first positional setting for a choke plate from a choke arm fixedly coupled with the choke plate;

receiving a second positional setting for the choke plate from a control arm adjustably coupled with the choke arm, wherein the second positional setting is provided by a heat responsive device that applies at least one torque to the control arm according to a sensor that detects whether an engine is running; and providing a plurality of fuel ratios for the engine based on corresponding positions of the choke plate from the cooperative relationship of the first positional setting and the second positional setting.

18. The method of claim 17, wherein the corresponding positions include a first position that corresponds to an ambient temperature and a stopped state of the engine, a second position that corresponds to the ambient temperature and a running state of the engine, a third position that corresponds to an increased temperature and the running state of the engine, and a fourth position that corresponds to the increased temperature and the stopped state of the engine.

19. The method of claim 17, wherein the heat responsive device includes a heater that receives a current from the sensor.

20. The method of claim 19, wherein the heat responsive device includes a bimetallic device configured to change shape in response to the heater.

* * * * *